US005600852A

United States Patent [19]

Densch

[11] Patent Number: 5,600,852

[45] Date of Patent: Feb. 11, 1997

[54] KNOTLESS INTERCHANGEABLE NECKWEAR

[76] Inventor: Daniel W. Densch, 46 Cocheco St., Dover, N.H. 03820

[21] Appl. No.: 615,018

[22] Filed: Mar. 8, 1996

[51] Int. Cl.[6] ..... A41D 25/00; A41D 25/02; A41D 25/04

[52] U.S. Cl. ..... 2/144; 2/145; 2/146; 2/148; 2/150

[58] Field of Search ..... 2/144, 145, 146, 2/147, 148, 149, 150, 151, 152.1, 153, 154, 155, 156, 157, 338, 310, 311, 312, 336, 340; 24/628

[56] References Cited

U.S. PATENT DOCUMENTS

| | | | |
|---|---|---|---|
| 1,510,398 | 9/1924 | Grandle | 2/314 |
| 3,439,360 | 4/1969 | Grubman | 2/155 |
| 4,825,515 | 5/1989 | Wolterstorff, Jr. | 24/625 |
| 5,222,279 | 6/1993 | Frano et al. | 24/625 |
| 5,322,037 | 6/1994 | Tozawa | 24/625 X |
| 5,507,076 | 4/1996 | Anscher | 24/625 |

*Primary Examiner*—Jeanette E. Chapman

[57] ABSTRACT

A knotless, interchangeable neckwear device incorporates a vertically elongated necktie panel, a male quick connect buckle component and a female quick connect buckle component collectively positioned in front of the wearer's neck by a looped connecting means detachably secured to an adjustable non-elastic neckband. The engaged male and female quick connect buckles are always directly visible by someone facing the front of the wearer. The quick connect buckles replace the traditional four-in-hand knot as a decorative design element and may be formed of materials such as wood, metal, or colored plastic providing an interesting and attractive appearance. The necktie panel is supported by the quick connect buckle components in a manner that allows for ready adjustment of the length of the front or display apron of the necktie panel according to a wearer's preference. The male and female quick connect buckle components allow the wearer to interchange one necktie panel for another by a one hand operation without the need for detaching the neckband.

2 Claims, 2 Drawing Sheets

KNOTLESS INTERCHANGEABLE NECKWEAR

TECHNICAL FIELD

The present invention relates generally to decorative neckwear and more specifically to knotless neckties with means of detachment, wherein the necktie panel is releasably secured to the neckband by male and female quick connect buckle components which permit interchangeability as well as ready length adjustment of the display apron of the necktie panel, whereby the male and female quick connect buckle components are prominently visible in front of a wearer's neck replacing the traditional four-in-hand knot as a decorative design element.

DESCRIPTION OF THE PRIOR ART

Conventional four-in-hand neckties have been worn by men and women for a number of decades and many efforts have been made to simplify or abolish the toilsome process of tying a well-proportioned knot and adjusting the length of the display apron of the necktie. Additionally, neckties are known in the prior art which incorporate quick release connectors to prevent the wearer from accidental injury or death in cases where the necktie is subjected to strong pulling forces. Invariably, inventors have concentrated their efforts to greater or lesser success on providing pre-tied neckties simulating the appearance of a hand-tied knot. Many of these assemblies are of complicated construction and a complete pre-tied necktie is required to be purchased when a new tie, such as one of a different color or design is desired.

U.S. Pat. No. 4,777,665 to Akamatsu discloses a quick-release necktie comprising a preliminary tied necktie base having a knot, neckbands extending of both sides of the knot and a pair of quick-releasable male and female fastening means attached to the ends of the neckbands. When the male and female fastening means are locked and interconnected or unlocked and disconnected, the necktie can be worn or released quickly. Moreover, if a large tension force acts on the necktie base, the engagement between the male and female fastening means is automatically released, thus preventing the tightening of the neckbands around the wearer's neck.

U.S. Pat. No. 5,048,127 to Yang discloses an interchangeable pre-tied necktie having a zippered adjustable inner tie which is interchangeable with a knot support so that a variety of different neckties can be used with the single zippered adjustable inner tie.

U.S. Pat. No. 5,088,120 to Yen discloses a necktie assembly wherein a necktie is looped through an elongated, slotted adjusting plate until the appropriate necktie panel length is displayed. Then the ends of a neck rope are run through a box like retainer which is placed inside a knot shaped sheath. This retainer is held in the sheath by running the ends of the neck rope through slots in this sheath. The panels and tail ends of the necktie are then placed in this sheath which is slid up the necktie until the sheath is stopped by the adjusting plate. The sheath covers and is held in place by the adjusting plate.

U.S. Pat. No. 5,235,704 to Collins discloses a necktie apparatus wherein two necktie segments are connected to a connector element releasably attaching these necktie segments. The wearer forms a knot in front of said connector effectively concealing it. The necktie segments disconnect automatically when a force of sufficient magnitude is applied to the tie, thus protecting the wearer from injury.

The present invention overcomes many of the drawbacks and deficiencies of such pre-tied neckties by replacing the traditional four-in-hand knot as a decorative design element with male and female quick connect buckle components which provide a unique and simple solution to assemble, adjust, disconnect and interchange a knotless necktie while maintaining the general impression created by traditional neckties.

SUMMARY OF THE INVENTION

In view of the foregoing, the present invention has been developed to provide a unique, knotless necktie that is of simple and inexpensive construction, easily detachable by a one-hand operation when a situation warrants the temporary removal of the necktie panel for safety reasons, and highly modular to provide instant interchangeability when a new necktie panel of different color or design is desired, and further affords ready adjustment of the length of the neckband as well as the length of the display apron of the necktie panel to a wearer's preference.

The present invention is characterized by a necktie panel having a front or display apron and a rear apron passing through an aperture at the distal end of the male quick connect buckle component positioned in front of the wearer's neck. These quick connect buckle components are always directly visible by someone facing the front of the wearer. In effect, said buckle components replace the four-in-hand knot as the decorative design element of traditional necktie designs. The buckle components include decorative matter; they may be formed of materials providing the admired beauty of natural wood grain, or the striking color effects achieved by colorfully anodized aluminum, or brightly colored plastic, or highly polished metals such as brass and copper, or precious metals, or if desired the many choices of ribbed, striated, glazed or mottled surfaces available with such materials. The female quick connect buckle component is secured to the neckband by a looped connecting means passing through the aperture at the female buckle component's distal end and encompassing the neckband. The neckband consists of an adjustable, non-elastic ribbon which may be detachably joined together by a hook and loop area or "Velcro" fasteners secured to their respective overlapping ends to secure the device in position under the wearer's collar.

Accordingly, a primary object of the present invention is to provide articles of decorative neckwear closely resembling in appearance the general form and impression created by four-in-hand tied neckties but with male and female fastening means, which are always directing visible by someone facing the front of the wearer, effectively replacing the four-in-hand knot of traditional necktie designs as a unique and decorative design element.

It is a further object of the present invention to provide articles of decorative neckwear where a necktie panel may be quickly attached to an adjustable neckband by a one hand operation.

It is still a further object of the invention to provide articles of decorative neckwear where a necktie panel may be quickly and safely detached from an adjustable neckband by a one hand operation.

Another object of the invention is to provide such articles of decorative neckwear where the length of the front or display apron of the necktie panel may easily be adjusted to a wearer's preference.

Still another object of the invention is to provide articles of decorative neckwear incorporating a looped connecting means detachably joining the neckband to the female quick connect buckle component.

It is a further object of the invention to provide articles of decorative neckwear incorporating an adjustable, non-elastic supporting neckband ribbon having its ends adapted for adjustable engagement to secure the device in position under the wearer's collar.

Other advantages, features, and objects of the present invention will become apparent to those ordinarily skilled in the art with reference to the following description and accompanying drawings.

BRIEF DESCRIPTION OF THE DRAWINGS

For a fuller understanding of the nature and objects of the present invention, reference should be had to the following detailed description taken in connection with the accompanying drawings, in which.

DETAILED DESCRIPTION OF THE DRAWINGS

Figure 1:
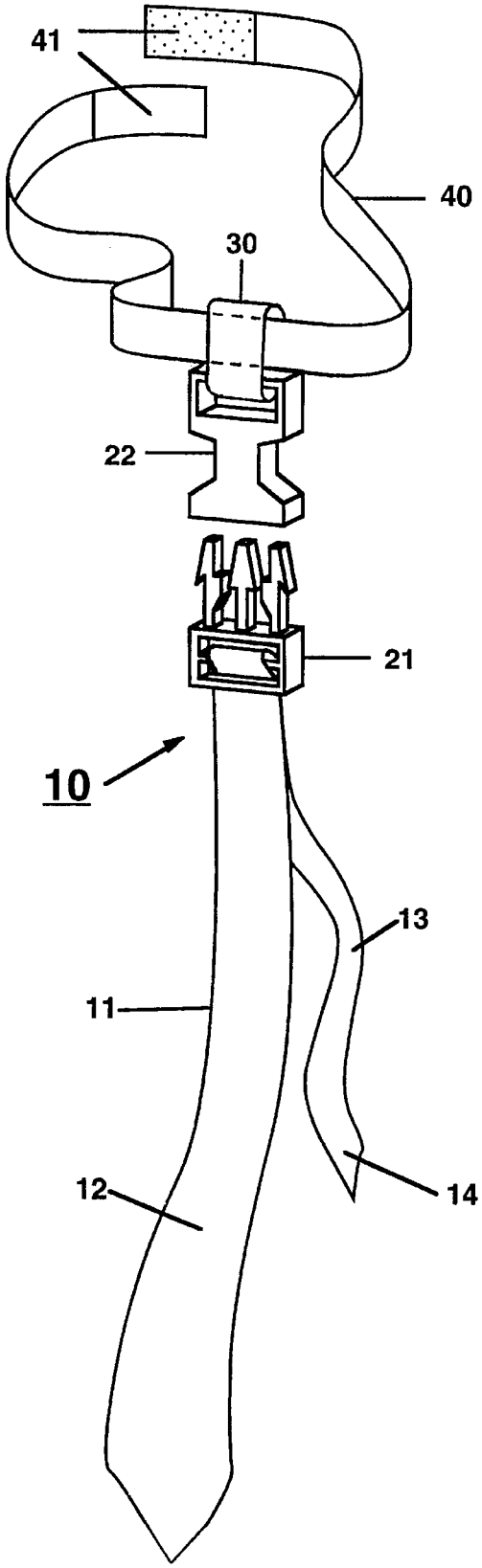
FIG. 1 is a front perspective view of the preferred embodiment of the invention displaying the entirety of the knotless, interchangeable neckwear device and showing the male and female quick connect buckle components in an open or uncoupled condition.

In the embodiment of the invention illustrated in FIG. 1, the knotless interchangeable neckwear device 10 is shown to comprise a flexible necktie panel 11 with a front apron 12 and a rear apron 13, a first connector element in the form of a male quick connect buckle component 21 and a second connector element in the form of a female quick connect buckle component 22 to be worn collectively under a wearer's chin, a looped connecting means 30, and a neckband 40. Connector elements 21 and 22 are always directly visible by someone facing the front of the wearer.

Necktie panel 11 is vertically elongated and formed of a synthetic or natural fiber woven fabric or other suitable type of flexible material, wherein front apron 12 is the display portion of necktie panel 11 and rear apron 13 is that portion of necktie panel 11 located behind front apron 12. Therefore, under normal wearing conditions, rear apron 13 is effectively concealed from view. The extremity 14 of rear apron 13 is trimmed diagonally across its width at an approximate angle of 45 degrees to facilitate entry into the aperture of male quick connect buckle component 21 when necktie panel 11 is assembled onto the buckle.

Figure 2:
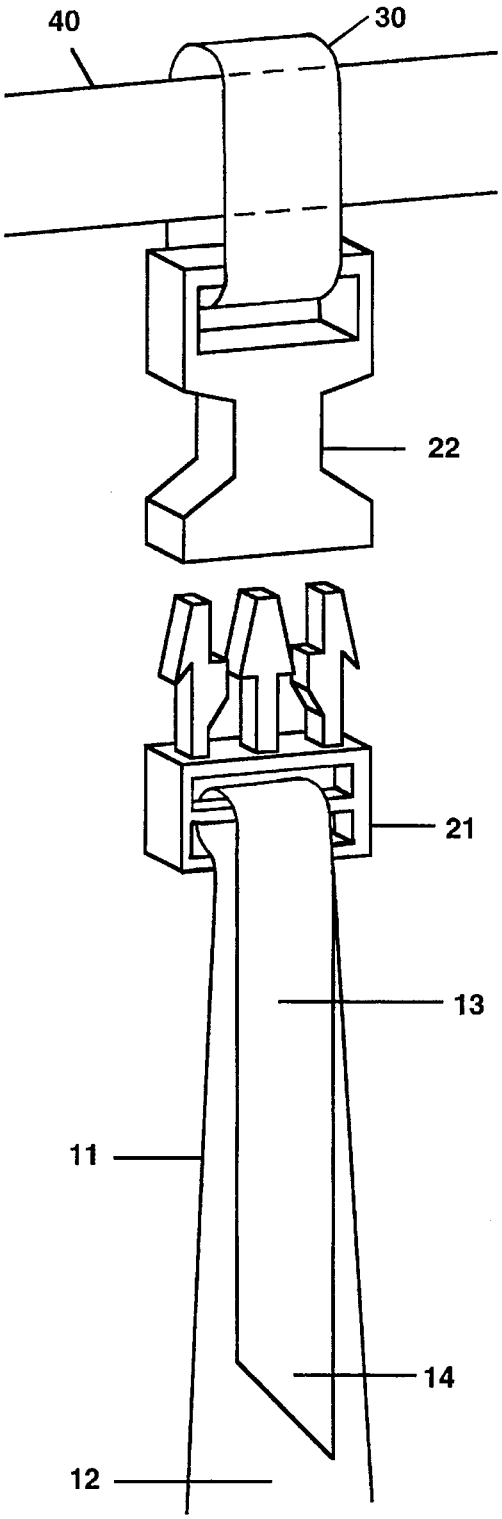
FIG. 2 is a fragmentary rear perspective view of the embodiment in FIG. 1.

The distal end of male quick connect buckle component 21 defines an aperture and two transverse fastening bars around which said extremity 14 of rear apron 13 is passed to adjustably secure it to male quick connect buckle component 21. The distal end of female quick connect buckle component 22, likewise defines an aperture and a transverse fastening bar and accepts one extremity of looped fastening means 30 which in the embodiment shown in FIG. 2 is fastened to itself by sewing or other suitable means effectively forming a continuous looped ribbon encompassing neckband 40 as well as said fastening bar.

The distal ends of neckband ribbon 40 are each provided with easily adjustable securing devices, preferably formed as hook and loop area or "Velcro" fasteners 41 stitched to opposite neckband ends as indicated in FIG. 1.

Figure 3:
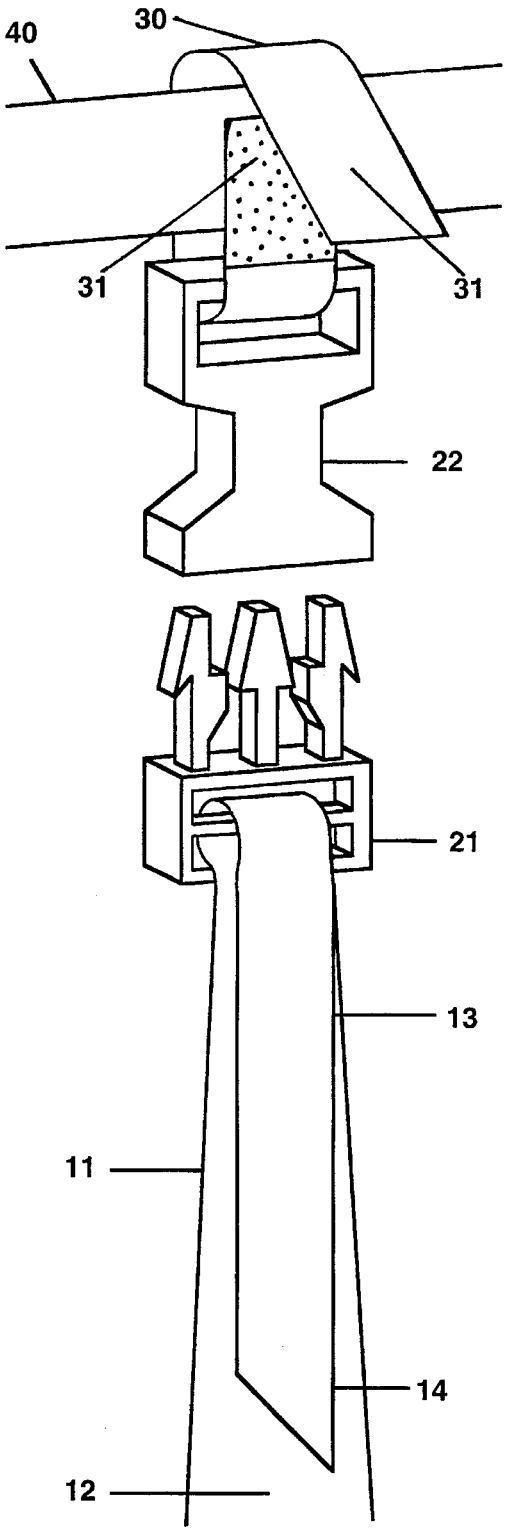
FIG. 3 is a fragmentary rear perspective view of an alternative looped connecting means detachably securing the female quick connect buckle component to the neckband.

An alternative construction of looped connecting means 30 is shown in FIG. 3 where the distal ends of a single ribbon 30 are each provided with easily adjustable securing devices, preferably formed as hook and loop area or "Velcro" fasteners 31 stitched to opposite ends to detachably secure female quick connect buckle component 22 to neckband 40.

I claim:

1. A knotless, interchangeable neckwear device comprising, in combination:

and always directly visible by someone facing the front of the wearer;

non-elastic neckband means adjustably and removably encircling the wearer's neck;

a buckle component having first and second connector elements;

said connector elements include decorative matter;

looped connecting means encompassing said neckband and passing through an aperture at a distal end of said first connector element of the said buckle component;

a vertically elongated necktie panel formed of flexible material having a front or display apron and a rear apron and passing through an aperture at a distal end of said second connector element of the said buckle component; and when said neckwear is worn by the wearer, said first and second connector elements of said buckle component are positionable in front of the wearer's neck and always directly visible by someone facing the front of the wearer.

2. The knotless interchangeable neckwear device defined in claim 1 wherein said looped connecting means is formed by a single fabric ribbon both ends of which are dimensioned to overlap behind the neckband, and are provided with respective cooperating hook and loop area fasteners detachably securable together.

* * * * *